US006054657A

United States Patent [19]

Liao

[11] Patent Number: 6,054,657

[45] Date of Patent: Apr. 25, 2000

[54] MULTIPLE SOCKET RECEPTACLE WITH CONTROL SWITCH ARRANGEMENT FOR ACTIVATING CIRCUITS ASSOCIATED WITH INSERTED PLUGS

[76] Inventor: Jui-Chung Liao, 58, Ma Yuan West St., Taichung, Taiwan

[21] Appl. No.: 09/236,024

[22] Filed: Jan. 22, 1999

[51] Int. Cl.[7] ..... H01R 19/00

[52] U.S. Cl. ..... 200/51.02; 200/51.03; 439/652

[58] Field of Search ..... 200/51 R, 51.01–51.04, 200/51.09, 51.1; 439/188, 189, 650–654

[56] References Cited

U.S. PATENT DOCUMENTS

| | | | |
|---|---|---|---|
| 2,502,658 | 4/1950 | Lindmark | 200/51.02 X |
| 2,792,561 | 5/1957 | Cohen | 439/652 |
| 2,851,550 | 9/1958 | Searcy | 200/51.02 |
| 3,246,179 | 4/1966 | Berner | 200/51.02 |
| 4,930,047 | 5/1990 | Peterson | 200/51 R X |
| 5,094,630 | 3/1992 | Jammet | 439/652 |

*Primary Examiner*—J. R. Scott

[57] ABSTRACT

A socket device has an upper casing, a lower casing coupling with the upper casing, a copper plate disposed in an interior of the socket device, two conductive devices disposed in the interior of the socket device, and one or more switch devices inserted in the upper casing. The upper casing has a number of through holes, a number of receptacles, a number of upper clamp bars, and a number of upper separation plates. Each upper clamp bar has a distal notch. Each receptacle has two slots. The driven plate is inserted in the respective through hole. The lower casing has a number of lower clamp bars, and a number of lower separation plates. Each lower clamp bar has an end notch.

8 Claims, 8 Drawing Sheets

MULTIPLE SOCKET RECEPTACLE WITH CONTROL SWITCH ARRANGEMENT FOR ACTIVATING CIRCUITS ASSOCIATED WITH INSERTED PLUGS

BACKGROUND OF THE INVENTION

The present invention relates to a socket device. More particularly, the present invention relates to a socket device which can receive a plurality of plugs stably.

A conventional socket device has two copper plates for contacting with two blades of a plug directly. When the user kicks the plug, the blades of the plug will be disengaged from the copper plates easily. Furthermore, the structure of the conventional socket device is very complex so that the cost of manufacture is expensive.

SUMMARY OF THE INVENTION

An object of the present invention is to provide a socket device which can receive a plurality of plugs stably.

Accordingly, a socket device comprises an upper casing, a lower casing coupling with the upper casing, a copper plate disposed in an interior of the socket device, two conductive devices disposed in the interior of the socket device in parallel, and at least a switch device inserted in the upper casing. The switch device has an L-shaped rod, a driven plate disposed on a first end of the L-shaped rod, a push plate disposed on a second end of the L-shaped rod, and an annular protrusion surrounding the L-shaped rod. Each of the conductive devices has at least a round hole and at least a protuberance. The copper plate has at least a round aperture. The upper casing has a plurality of through holes, a plurality of receptacles, a plurality of upper clamp bars, and a plurality of upper separation plates. Each of the upper clamp bars has a distal notch. Each of the upper separation plates has a protruded point and a plurality of round recesses. Each of the receptacles has two slots. The driven plate is inserted in the respective through hole. At least two protection plates are disposed on the upper casing to protect the driven plate. The lower casing has a plurality of lower clamp bars, and a plurality of lower separation plates. Each of the lower clamp bars has an end notch. Each of the lower separation plates has a plurality of round protrusions. Each of the round protrusions is inserted through the respective round hole and inserted in the respective round recess. The annular protrusion of the L-shaped rod is inserted in the respective distal notch and the respective end notch.

DETAILED DESCRIPTION OF THE INVENTION

Figure 1:
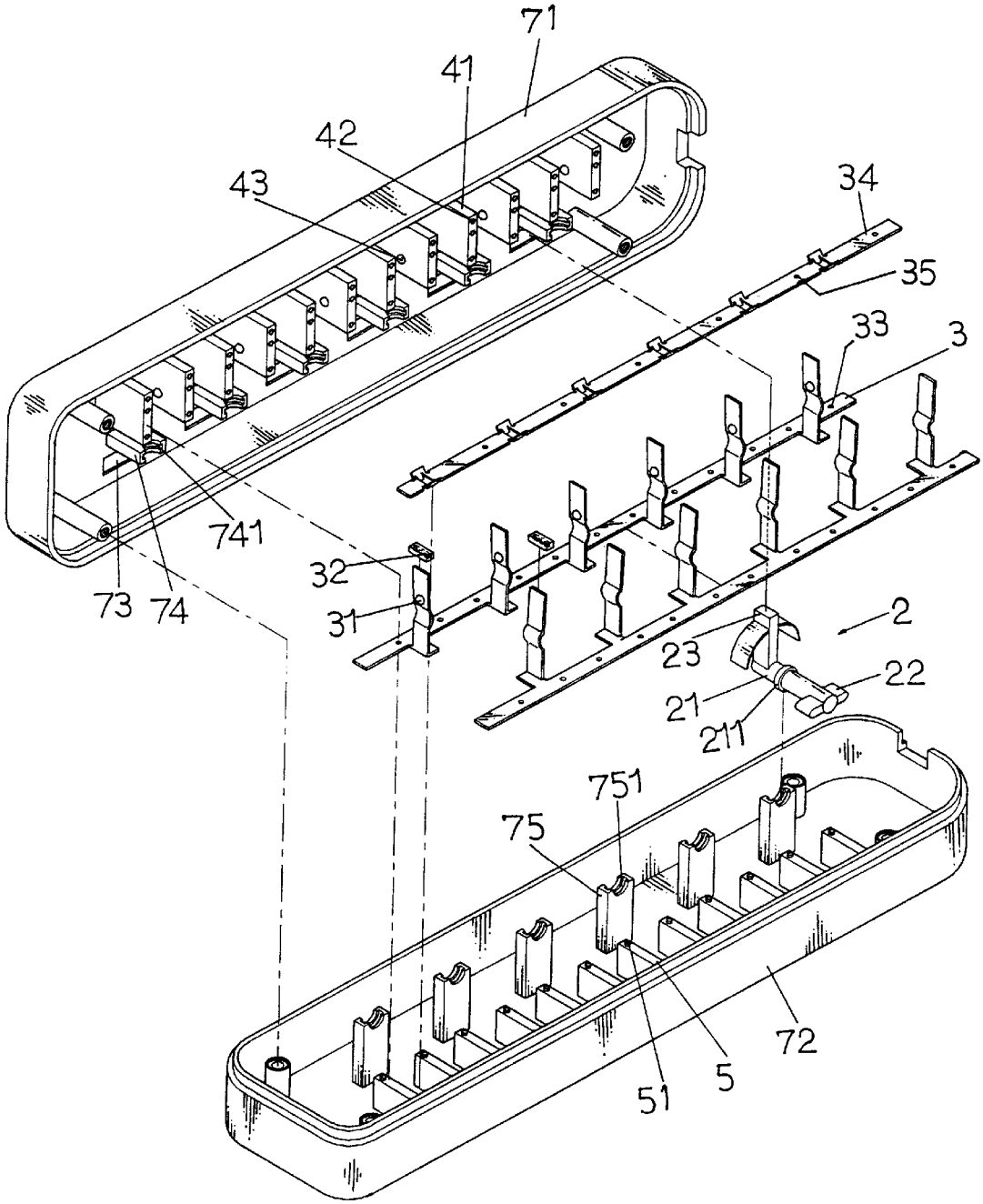
FIG. 1 is a perspective exploded view of a socket device of a first preferred embodiment in accordance with the present invention.
Figure 2:
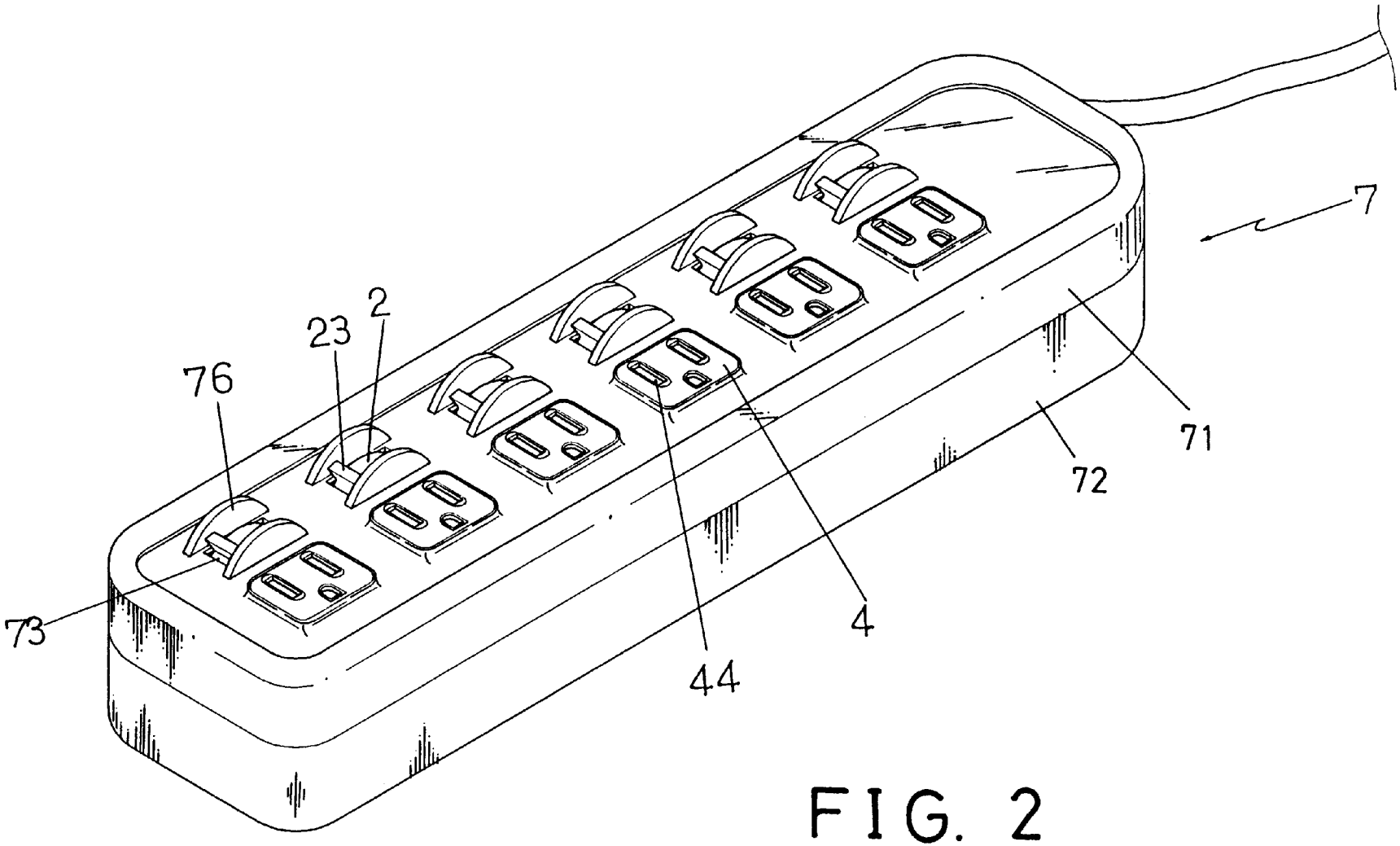
FIG. 2 is a perspective assembly view of a socket device of a first preferred embodiment in accordance with the present invention.
Figure 3:
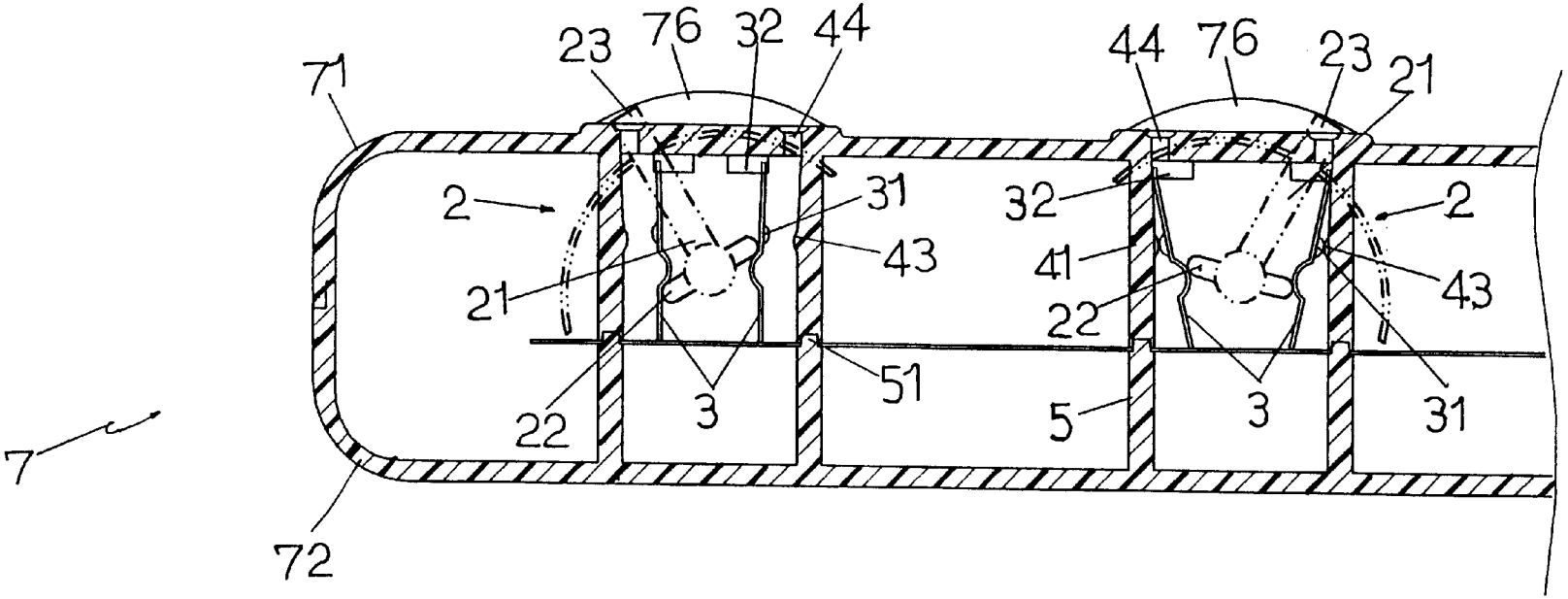
FIG. 3 is a partially sectional view of a socket device of a first preferred embodiment in accordance with the present invention.
Figure 4:
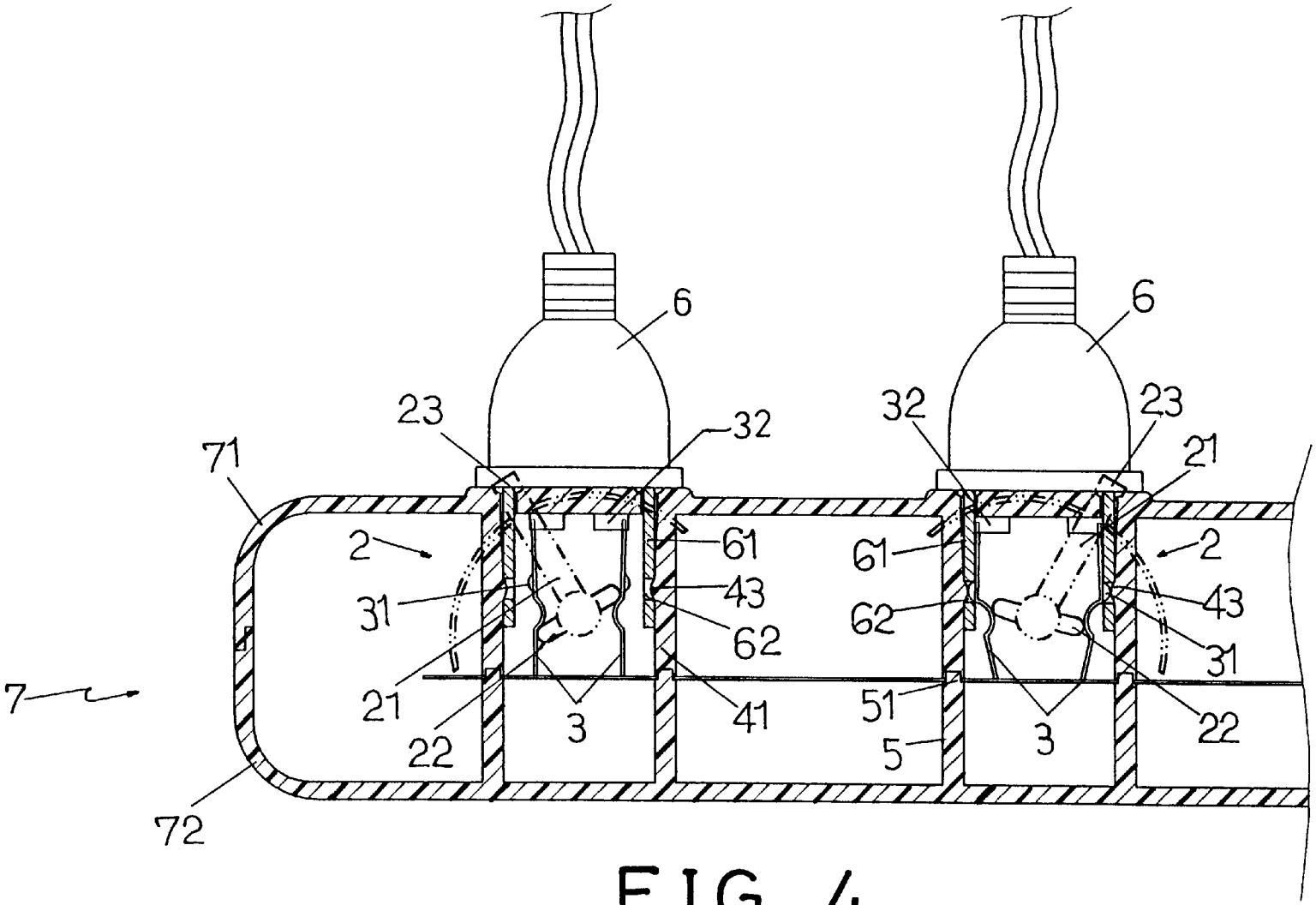
FIG. 4 is a schematic view illustrating two plugs engaging with a socket device of a first preferred embodiment in accordance with the present invention.

Referring to FIGS. 1 to 3, a first socket device 7 comprises an upper casing 71, a lower casing 72 coupling with the upper casing 71, a copper plate 34 disposed in an interior of the socket device 7, two conductive devices 3 disposed in the interior of the socket device 7 in parallel, and at least one switch device 2 inserted in the upper casing 71.

The switch device 2 has an L-shaped rod 21, a driven plate 23 disposed on a first end of the L-shaped rod 21, a push plate 22 disposed on a second end of the L-shaped rod 21, and an annular protrusion 211 surrounding the L-shaped rod 21.

Each of the conductive devices 3 has at least one round hole 33, at least one flexible contact and at least one protuberance 31.

The copper plate 34 has at least one round aperture 35.

The upper casing 71 has a plurality of through holes 73, a plurality of receptacles 4, a plurality of upper clamp bars 74, and a plurality of upper separation plates 41. Each of the upper clamp bars 74 has a distal notch 741. Each of the upper separation plates 41 has a protruded point 43 and a plurality of round recesses 42. Each of the receptacles 4 has two slots 44.

The driven plate 23 is inserted in the respective through hole 73. At least two protection plates 76 are disposed on the upper casing 71 to protect the driven plate 23.

The lower casing 72 has a plurality of lower clamp bars 75, and a plurality of lower separation plates 5. Each of the lower clamp bars 75 has an end notch 751. Each of the lower separation plates 5 has a plurality of round protrusions 51. Each of the round protrusions 51 is inserted through the respective round hole 33 and inserted in the respective round recess 42.

The annular protrusion 211 of the L-shaped rod 21 is inserted in the respective distal notch 741 and the respective end notch 751. A plurality of dustproof plastic covers 32 are disposed on top portions of the conductive devices 3.

Referring to FIGS. 1 to 4, two plugs 6 engage with the socket device 7. Each of the plugs 6 has two blades 61 inserted in the slots 4. Each of the blades 61 has a groove 62. The push plate 22 contacts the flexible contacts of the conductive devices 3. When the push plate 22 remains in an on position, the push plate 22 pushes the conductive devices 3 into contact the blades 61. The protuberance 31 is inserted in the respective groove 62.

Figure 5:
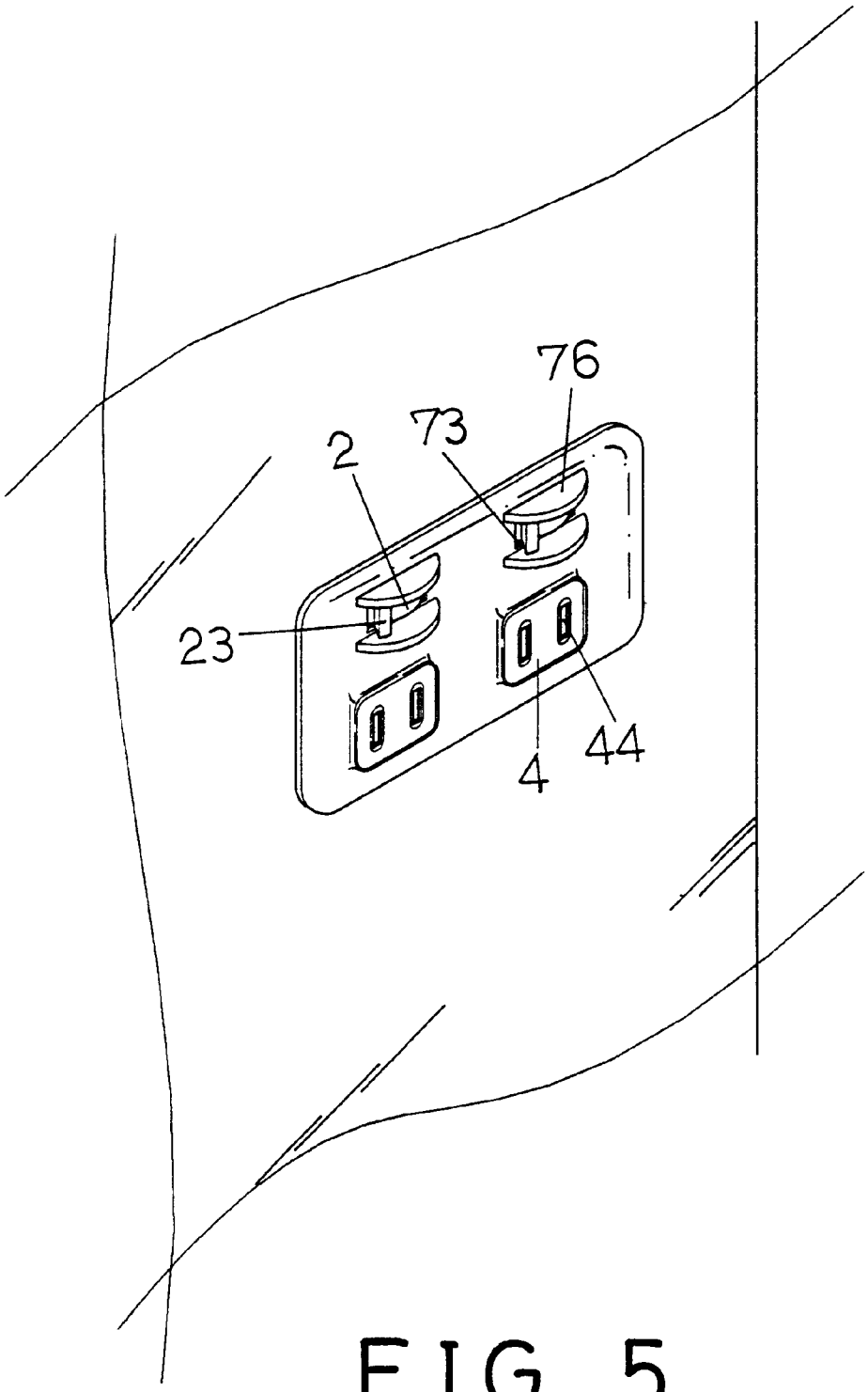
FIG. 5 is a schematic view illustrating a socket device of a second preferred embodiment disposed on a wall.

Referring to FIG. 5, a second socket device 7 has two receptacles 4 and two switches 2. Each of the receptacles 4 has two slots 44. Each of the switches 2 is protected by two protection plates 76. Each of the switches 2 has a driven plate 23. Two through holes 73 are formed on the second socket device 7. Each of the through holes 73 receives the respective driven plate 23. The second socket device 7 is disposed on a wall.

Figure 6:
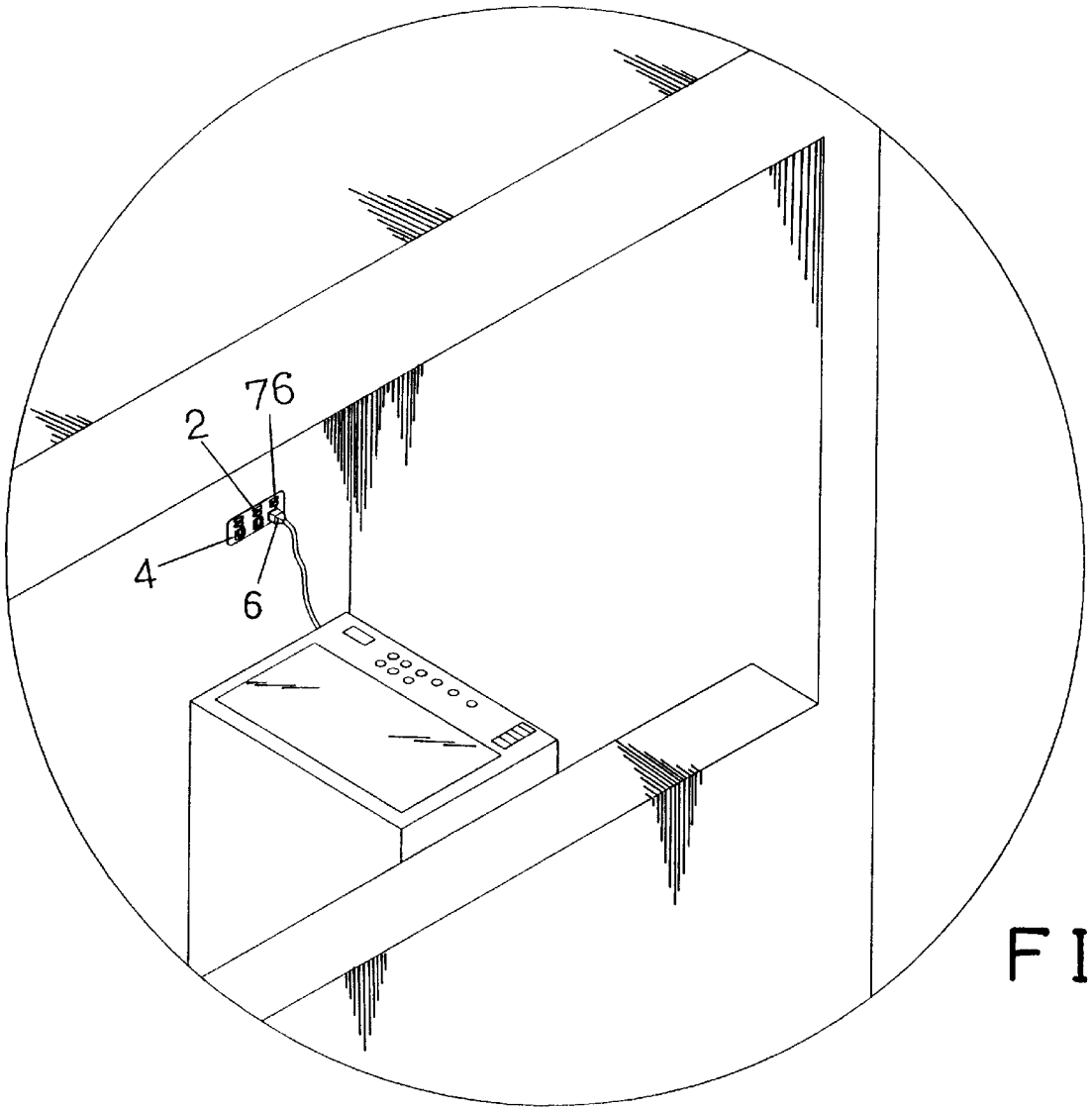
FIG. 6 is a schematic view illustrating a socket device of a third preferred embodiment disposed on a wall.

Referring to FIG. 6, a third socket device 7 has three receptacles 4 and three switches 2. The third socket device 7 is disposed on a wall.

Figure 7:
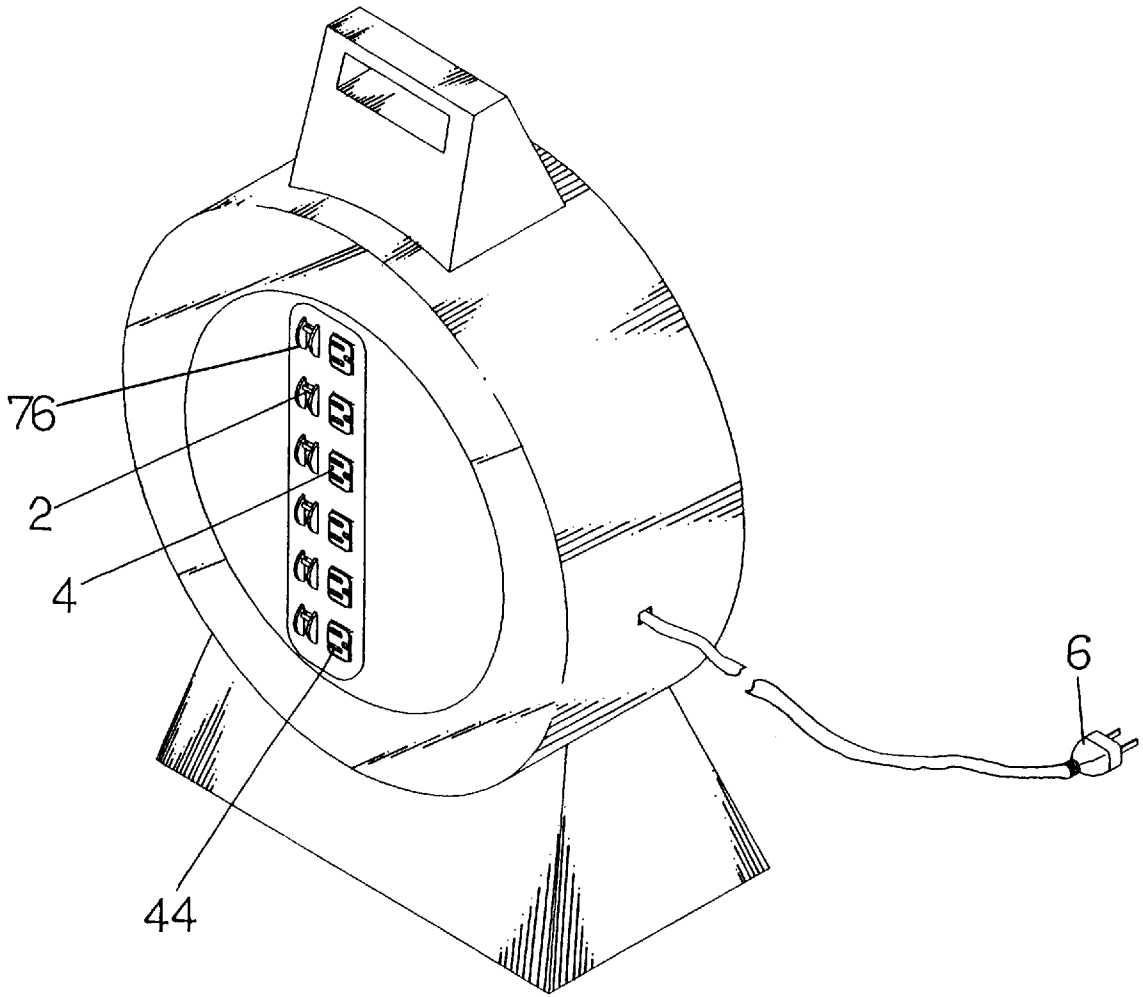
FIG. 7 is a perspective view of a socket device of a fourth preferred embodiment in accordance with the present invention.

Referring to FIG. 7, a fourth socket device 7 has a plurality of receptacles 4 and a plurality of switches 2. Each of the receptacles 4 has two slots 44. Each of the switches 2 is protected by two protection plates 76. The fourth socket device 7 has a disk shape. A wire is connected to a plug 6 and the fourth socket device 7.

Figure 8:
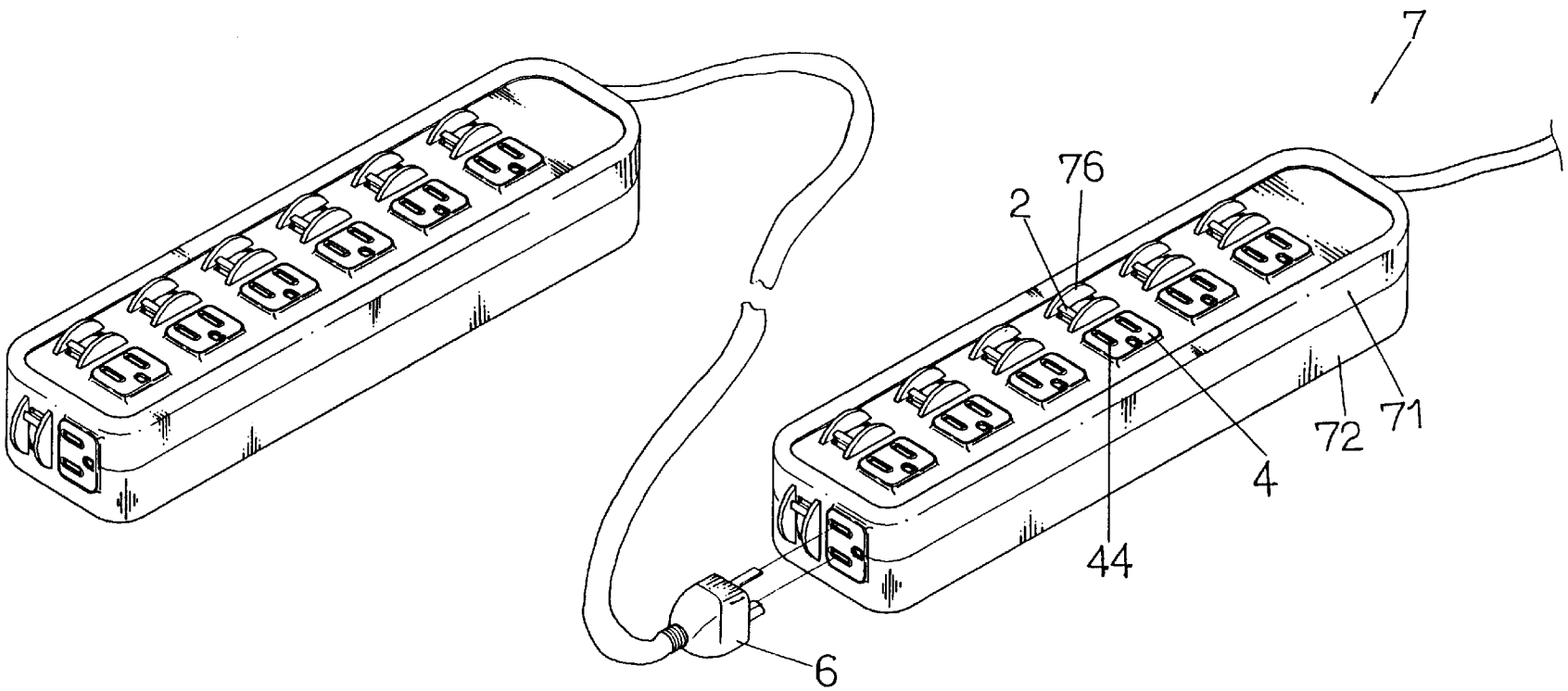
FIG. 8 is a perspective view of a socket device of a fifth preferred embodiment in accordance with the present invention.

Referring to FIG. 8, two socket device 7 are connected together via a wire and a plug 6.

Therefore, the socket device of the present invention can receive a plurality of plugs stably.

The invention is not limited to the above embodiment but various modification thereof may be made. Further, various changes in form and detail may be made without departing from the scope of the invention.

What is claimed is:

1. A socket device for activating circuits associated with inserted plugs, said socket device comprising:

a) an upper casing and a lower casing secured to said upper casing, said upper casing including at least one receptacle having two slits formed therein for receiving the prongs of one of said plugs, b) two conductive devices disposed in said upper casing and said lower casing, said conductive devices having complementary flexible contacts for each receptacle, and c) at least one switch device disposed in said upper casing and including a rod having a first end and a second end, said first end of said at least one switch device including a driven plate disposed thereon, said second end of said at least one switch device including a push plate disposed thereon and disposed between complementary flexible contacts of said conductive devices, said push plate of said at least one switch being disposed between said conductive devices to force said conductive devices to engage with the blades of one of the plugs when said push plate is actuated with said rod.

2. The socket device according to claim 1, wherein said upper casing includes at least one through hole formed therein for receiving said driven plate.

3. The socket device according to claim 1, wherein said upper casing includes at least two protection plates disposed thereon for protecting said driven plate.

4. The socket device according to claim 1, wherein said upper casing includes at least one upper clamp bar, said lower casing includes at least one lower clamp bar, said rod is rotatably secured between said upper and said lower clamp bars.

5. The socket device according to claim 4, wherein said at least one upper clamp bar includes a notch formed therein, said at least one lower clamp bar includes a notch formed therein, said rod includes an annular protrusion provided thereon and rotatably received in said notches of said upper and said lower clamp bars and secured between said upper and said lower clamp bars.

6. The socket device according to claim 1, wherein said upper casing includes a plurality of upper separation plates each having a protruded point for engaging with the blades of said plugs.

7. The socket device according to claim 1, wherein said upper separation plates each includes at least one round recess formed therein,said lower casing includes a plurality of lower separation plates each having at least one round protrusion extended therefrom for engaging into said at least one round recess of said upper separation plate.

8. The socket device according to claim 1, wherein said conductive devices each includes at least one protuberance provided thereon for engaging with the blades of said plugs.

* * * * *